United States Patent [19]

Lohausen

[11] Patent Number: 4,794,971

[45] Date of Patent: Jan. 3, 1989

[54] AWNING

[76] Inventor: Viktor Lohausen, Goldmühlestrasse 99/2, D-7032 Sindelfingen, Fed. Rep. of Germany

[21] Appl. No.: 11,458

[22] Filed: Feb. 6, 1987

Related U.S. Application Data

[63] Continuation of Ser. No. 685,327, Dec. 24, 1984, abandoned.

[30] Foreign Application Priority Data

Dec. 30, 1983 [CH] Switzerland ..... 6993/83

[51] Int. Cl.[4] ..... E04F 10/06

[52] U.S. Cl. ..... 160/66; 160/121.1; 160/133; 160/900

[58] Field of Search ..... 160/19, 22, 66, 68, 160/69, 70, 72, 54, 55, 61, 62, 196 D, 166 A, 121.1, 133

[56] References Cited

U.S. PATENT DOCUMENTS

| | | | |
|---|---|---|---|
| 544,371 | 8/1895 | Ortmann | 160/133 |
| 591,918 | 10/1897 | Friedrich | 160/61 X |
| 709,913 | 9/1902 | Lamb et al. | 160/180 |
| 1,318,820 | 10/1919 | Watkins | 160/121 X |
| 1,557,058 | 10/1925 | Johansen | 160/196 D |
| 1,573,159 | 2/1926 | Gross . | |
| 1,622,245 | 3/1927 | Bliss | 160/55 |
| 1,649,943 | 11/1927 | Boeck | 160/133 X |
| 1,750,271 | 3/1930 | Kasan . | |
| 1,786,048 | 12/1930 | Williams | 160/121 X |
| 2,060,582 | 11/1936 | Leffert . | |
| 2,100,976 | 11/1937 | Norton | 160/133 |
| 2,173,275 | 9/1939 | Houmere | 160/166 A |
| 2,207,420 | 7/1940 | Thomas | 160/196 D |
| 2,426,133 | 8/1947 | Willis | 160/54 |
| 2,572,257 | 10/1951 | Gerner et al. | 160/72 |
| 2,898,983 | 8/1959 | Etten . | |
| 3,991,805 | 11/1976 | Clauss | 160/22 |
| 4,335,775 | 6/1982 | Frentzel et al. | 160/176 R X |

FOREIGN PATENT DOCUMENTS

| | | |
|---|---|---|
| 829881 | 4/1938 | France . |
| 1229964 | 3/1960 | France . |
| 1249000 | 11/1960 | France . |
| 2033508 | 11/1970 | France . |
| 274744 | 4/1951 | Switzerland . |
| 15519 | of 1910 | United Kingdom . |

*Primary Examiner*—Ramon S. Britts
*Assistant Examiner*—David M. Purol
*Attorney, Agent, or Firm*—Ostrolenk, Faber, Gerb & Soffen

[57] ABSTRACT

Awning with a canopy consisting of several strips (18) extending in the direction of extension which are rolled up on one and the same canopy roller.

The longitudinal edges of the strips (418, 518, 618) can overlap one another, and the strips (418, 518) can be attached on the canopy roller (13, 113), offset with respect to one another in the circumferential direction thereof, while being connectible to one another along their longitudinal edges by the use of a fastening device such as a bristle trim or the like (23, 24), or with the edges adjacent each other without overlapping, whereby the edges can be released or separated by the application of wind pressure.

8 Claims, 4 Drawing Sheets

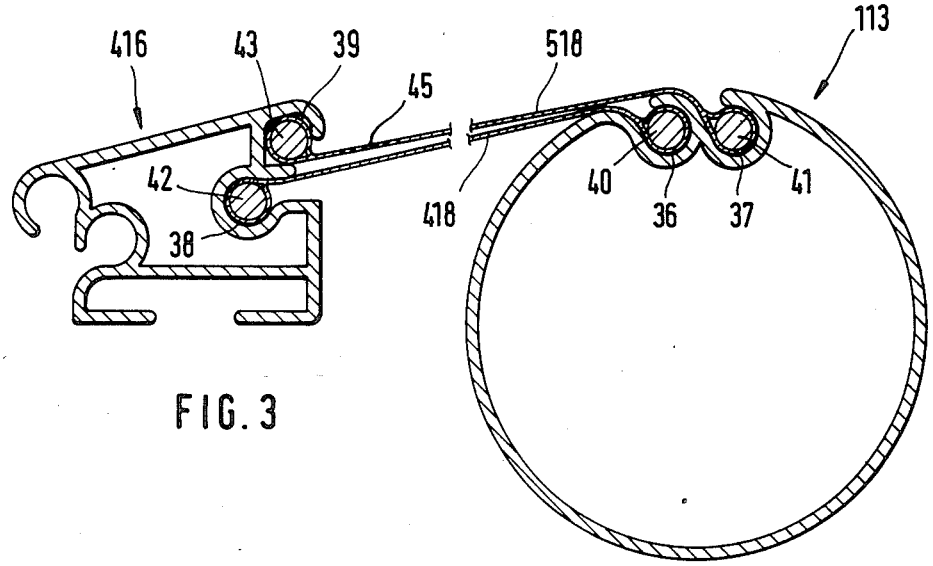
FIG. 3
FIG. 4a
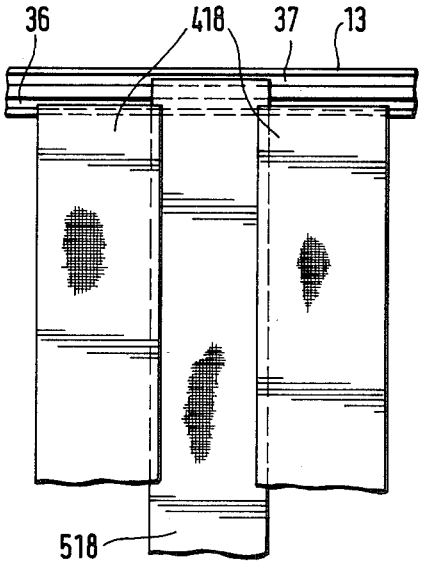
FIG. 4b
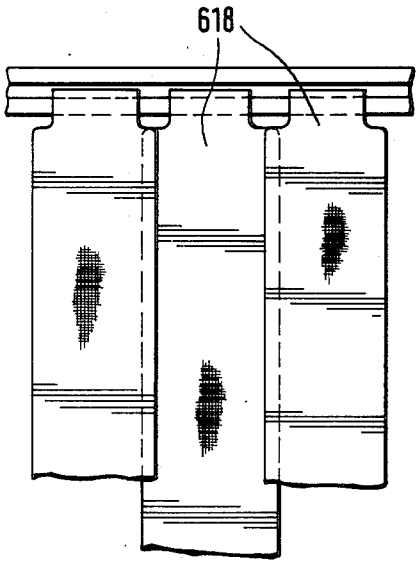

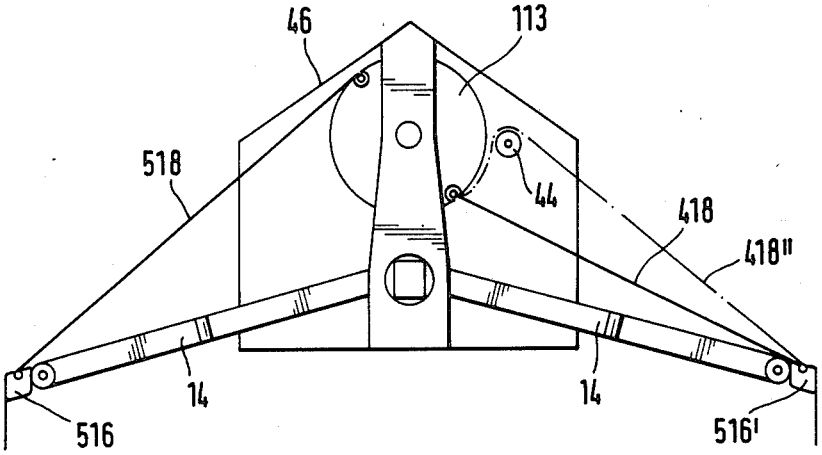
FIG. 5
FIG. 6
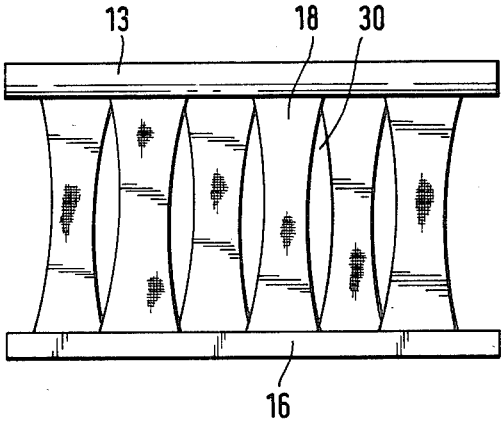
FIG. 7
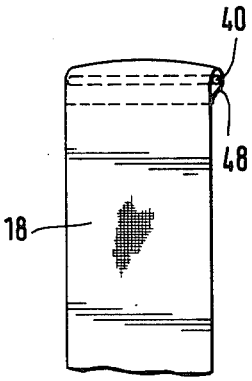

FIG. 8
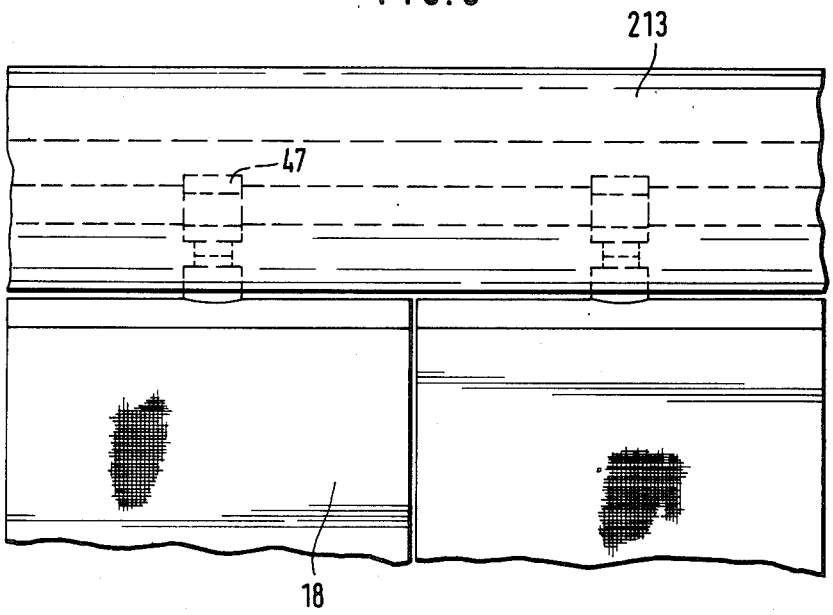
FIG. 9
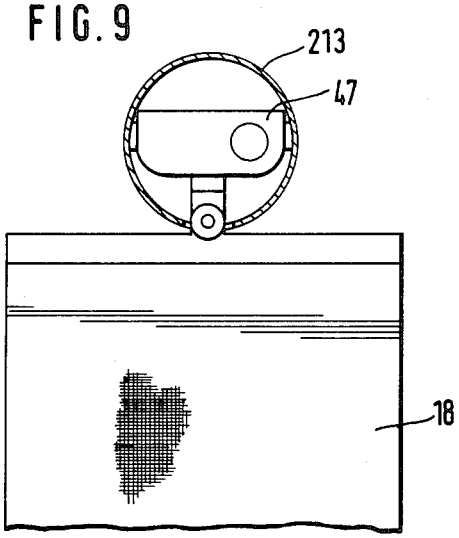
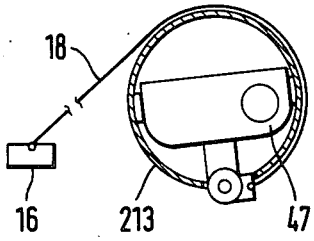
FIG. 10

AWNING

This is a continuation application of Ser. No. 685,327, filed Dec. 24, 1984, now abandoned.

FIELD OF THE INVENTION

The invention relates to an awning which is attached to a flexible canopy which can be pivoted from nearly horizontal to nearly vertical to a building structure by a suitable frame, and in which the canopy consists of several strips.

BACKGROUND OF THE INVENTION

An awning of this type has been proposed on various occasions. Hence, CH-A-274.744 shows a sunshade, with which the transversely extending canopy strips are attached across their width at a distance from one another to two fabric belts which can be rolled up on the canopy roller, while the part of the strips facing outward hangs down freely. Such a construction is relatively complicated in that when being rolled up and unrolled problems were encountered with the strips hanging downward, so that it did not find acceptance.

Most generally, the canopy extends between a spanning profile which is fastened to articulated arms, drop arms or the like, and a canopy roller on which it can be rolled up. In the unrolled condition the canopy is subjected to the pressure of the wind, which demands not only high tearing strength of the canopy, but also a massive design configuration of the frame which has the appearance of being ponderous, especially with regard to the articulated arms or similar means of extension, so that high manufacturing costs are also incurred.

For this reason it has already been proposed that a larger canopy area be divided into several smaller single awnings, e.g. in FR-A-829.881 for an awning extending around the corner of a building. Due to the necessity of the large number of canopy rollers, each with its own drive and means of extension, such a design is however extraordinarily expensive.

SUMMARY OF THE INVENTION

It is the object of the invention to create an awning which in spite of a relatively light construction can also withstand heavier wind gusts, and through which the aforementioned disadvantage of known awnings are eliminated. The foregoing is accomplished by the present invention by the strips extending from the spanning profile to the canopy roller, and by their capability of being rolled up on one and the same canopy roller.

Visually, in the extended or unrolled condition a canopy of such a construction scarcely differs from a canopy made of a single piece. When the canopy is attacked by the wind the spaces between the strips open to a greater or lesser extent and permit the passage of the greater part of the moving air, so that the residual air pressure buildup on the strips is very low. The canopy, which is consequently subjected to substantially lower stressing, can hence be of lighter construction, which also applies for the frame or the means of extension. This results in a light construction, which due to its smaller dimensioning can also be installed in constricted locations, and consequently in lower manufacturing costs. In the event of damage to the canopy only the damaged strips need be replaced.

The keeping in stock of canopies of different sizes and color combinations is troublesome and costly. The strip configuration affords the possibility of combining the strips to produce the respective canopy width required in increments corresponding to the width of the strips. In addition, the colors and their arrangement can be varied to comply with the desires of customers.

Advantageous improvements and further embodiments are disclosed in the specification, with reference to the drawings.

BRIEF DESCRIPTION OF THE DRAWINGS

Schematically illustrated examples of embodiments of the invention can be seen in the drawings. Shown are.

DETAILED DESCRIPTION OF THE DRAWINGS

Figure 1:
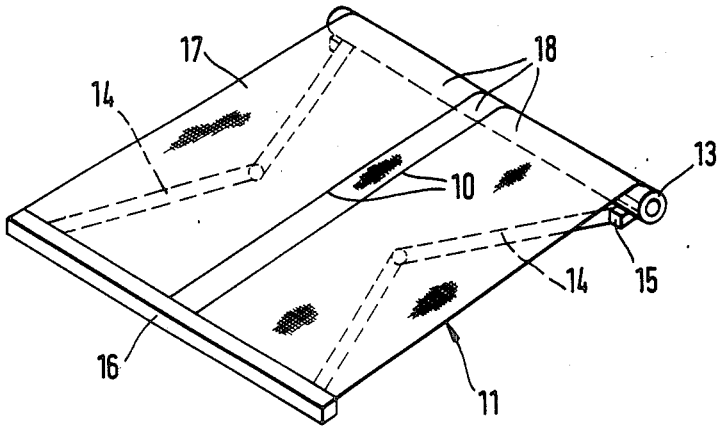
FIG. 1 perspective view of an awning with a canopy which can be unrolled and rolled up, FIG. 2 a perspective view of various joining possibilities of the longitudinal edges of the strips, as well as a fixation of the strips on the spanning profile, FIG. 3 a schematic cross section through an awning, FIGS. 4*a* and 4*b* details of awnings with the canopy strips fastened to the canopy roller, FIG. 5 a cross section of a double awning, and FIG. 6 a plan view of a canopy, FIG. 7 plan view of the end area of a strip, FIGS. 8 to 10 plan view and cross section of a part of an awning on the canopy roller side of the strips.

FIG. 1 shows schematically a rolling-type sun-shade or awning 11, the canopy 17 of which is fastened at one end to the canopy roller 13, and at the other end to a spanning profile 16. The canopy roller 13 is mounted rotatable and operable in a known manner to supporting elements (not shown). Articulated arms 14 are fastened to pivoting bearings 15 which support the spanning profile 16.

The canopy 17 of flexible textile material supported by the spanning profile 16 on the one end and the canopy roller 13 on the other is divided into strips 18. The strips 18 can be of equal width, or as shown in the example of different widths. The strips 18 extend in the direction of unrolling. When at rest the longitudinal edge 10 of two adjacent strip touch one another.

Figure 2:
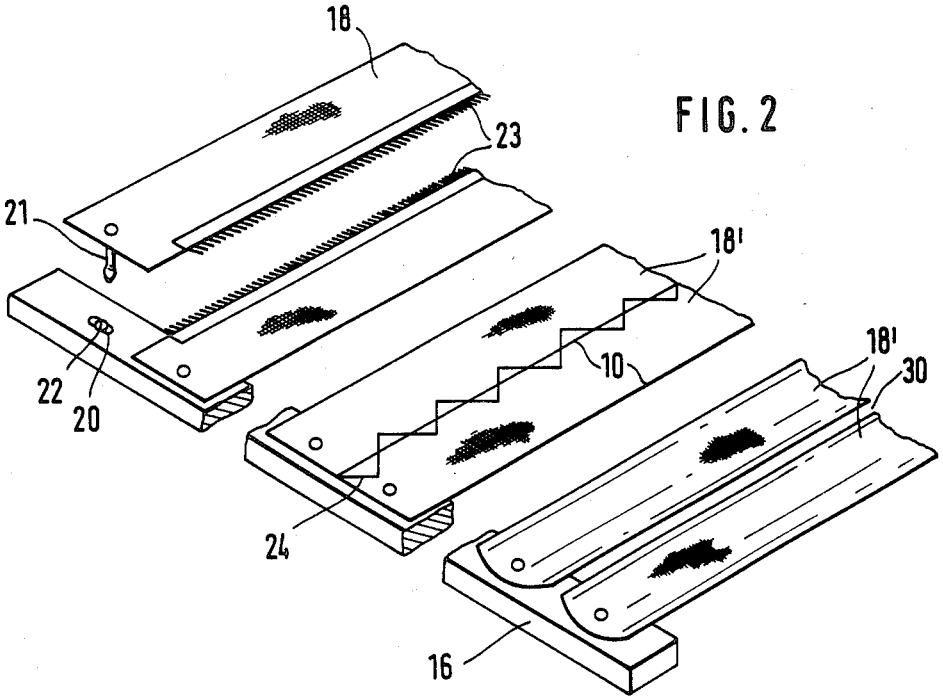

As also shown by FIG. 2 the strips 18 can be arranged in a plane so cloesly to one another that the longitudinal edges 10 are closed. Every strip 18, 18' is fastened to the spanning profile 16 preferably in the middle so that on loading by the wind from below, the longitudinal edges 10 of the strips 18' can arc upward, whereby openings 30 are produced. The strips can also be fastened on the longitudinal edge of every strip facing the main wind direction; however, more stable is a fixation on at least two points of their ends by means of a fixation strip, a clamping profile or the like.

For the fixation of the fabric strips 18' holes 20 are avoided in the spanning profile 16 - at spacings corresponding to the width of the strips - which can be fitted in the known manner with retaining springs 22 for holding a press button 21 to the strip 18, 18'. Any other design of such a quick-lock connection is naturally possible. However, with high wind velocities such a resilient fixation is possibly not sufficiently sure, so that a connection unreleasable in the interlocked condition is more expedient. For this purpose the bulge end of the press button 21 can additionally be inserted into the wide end of a keyhole opening which is arranged in a slide on the spanning profile 16, whereupon the slide is shifted such that the narrower part of the keyhole opening grips the neck of the press button 21 below the bulge, thereby holding it fast.

In order that in the case of the strips 18 having low stiffness, fluttering in the presence of slight air movement is avoided, the longitudinal edges of the strips 18 can be fitted with devices which open under pressure loading, such as e.g. a large number of intermeshing, elastic barbs, connectible or releasable positive connections or the like.

The edge of the fabric strips 18 can also be fitted e.g. with a bristle trim 23, the bristles of adjacent fabric strips intermeshing to offer the opening of the slots a certain resistance, thereby avoiding fluttering in the case of slight winds.

The strips 18' can also be joined to adjacent strips at the longitudinal edges by a joining seam with elastic threads 24, especially such of elastic polyurethane plastic, thereby also producing a certain counterforce against opening of the spaces 30. The use of plastic is advisable because when exposed to the sun natural rubber ages all too quickly. If the closing force achievable by a seam extending over the entire length of the strip should be too high, it is also possible to produce the seam in segments, meaning with interruptions.

Seams at the end of the strips 18 extending across the width can be used to fasten the canopy to the spanning profile 16. An essentially punctiform anchoring by means of rubber threads is however also possible. Due to such elastic anchoring the strips 18 can move apart from one another to the extent that the canopy allows the air to pass through excellently. On the other hand the anchoring in the form of the quick-lock connection 20–22 offers certain advantages with regard to an individual composition of canopies, which can quickly be changed in the desired width and color combination.

As shown in FIG. 3 the ends of the strips 418, 518 extending in the direction of unrolling can be located in two slots 36, 37 in the canopy roller 113 which are arranged offset in the circumferential direction, and fastened with fixation bars or fixation inserts 40, 41. The opposite ends of the strips 418, 518 are correspondingly fastened in two parallel slots 38, 39 in the spanning profile 416 by fixation bars or inserts 42, 43. The slots 36, 37 and 38, 39 arranged in pairs are expediently spaced at a small enough distance from one another that in the extended condition the strips 418, 518 are arranged directly on top of one another.

If the longitudinal edges of the strips 418, 518 overlap, which is shown by the plan view in FIG. 4*a*, it is expedient for the distance between the slots 36 and 37 and between slots 38 and 39 to correspond to one another, so that strips of standardized length can be used. Since due to slightly larger winding radius the strip on the top 518 requires somewhat fewer rotations to be wound up than does the lower strip 418, it is expedient to mount the upper strip elastically on the spanning profile, e.g. to provide for length compensation by the installation of a rubber band 45 or of a spring not shown, preferably near the spanning profile 16, 416.

As shown in FIG. 4*b* overlapping strips 618 can also be provided in only one slot in the canopy roller or in the spanning profile, in which case the end area of every strip 618 to be fastened is narrower than the width of the strip itself. However, here problems can be encountered with the insufficient tensioning of the longitudinal edges.

At the canopy roller and the spanning profile normal cloth strips would, to be sure, lie flush next to one another, but in the middle they would be agape with usual awning materials, a strip width of 200 mm and an extended length of 300 cm would produce gaps 30 of 1–3 cm. Irritating strips of light or rays of the sun would thereby pass through the canopy, which as is shown in FIG. 6 is unattractive.

This problem can be solved e.g. as shown FIG. 7 by the longitudinal edges of the strips 18, in contrast to the middle zones, being held under pull tension by the hollow seam 48 provided for the insertion of the fixation bars or inserts 40 being of convex configuration, so that in the extended, tensioned condition the edge zones are somewhat shorter than the middle zones. However, the strips 18 can also be stabilized transverse to the extension or spanning direction. This can be accomplished by transversely extending stiffening inserts, or by the use of inelastic textile material, for example fiberglass fabric, whereby with tensile stressing in longitudinal direction shrinkage of the strips in the transverse direction can be prevented or at least kept to a minimum. Transverse threads which relative to the longitudinal threads are very stiff can also be used to improve the transverse stablity.

The longitudinal edges can be reinforced for tensile resistance or be constructed more elastic than the middle zone. The reinforcement of the longitudinal edges can be effected by the construction of seams, a thicker selvedge, the application of high tensile strength edge bands or the like, which however involves the disadvantage that on rolling up the thickness of the rolled-up canopy is determined by the thicker edge zones, and the middle zones will sag. In the course of time this can result in turn in distortion. A reinforcement of the longitudinal edges without an increase in thickness is expediently achieved by the girth seam being sewn with a slight prestress (e.g. crimp cloth with elastic threads) possibly zigzagged; or in the manufacture of the fabric strips more or less elastic material is selected for the selvedge warp threads.

Using the principle according to FIG. 3 a double awning is also possible according to FIG. 5 as is used for stand awnings, for covering greenhouses or the like. The two canopies are formed by strips 418, 518 and are rolled onto and off a canopy roller 113. At the opposite end each awning is fastened to a spanning profile 516 and 516'.

Alternatively, the strips 418 can also be deflected via a deflection roll 44 along a plane 418" which then has the same angle of inclination as that of strips 518.

The invention is not limited to the embodiments shown. Hence, the canopy roller can be furnished with four slots to combine the embodiment as shown in FIG. 4*a* with that shown in FIG. 5.

However, a further advantage of the lamella concept is that in sewing, as well as in delivering the canpoy materials in folded condition, certain deformations or creases can be avoided only with great difficulty. Strips, however, need not necessarily be sewn in the longitudinal direction, but are supplied in rolls. In this way two problems are solved at one stroke. Even with very wide awnings a canopy roller support is installed to avoid sagging, with the consequence that dust and dirt are rubbed into the fabric and that wearing marks are incurred which cannot be eliminated, so that the entire canopy must be changed. With the canopy comprised of strips a damaged or soiled strip can be changed unproblematically.

In the example a shown by FIG. 8 worm gearings 47 are arranged at a distance corresponding to the width of the strips 18 in the longitudinally slotted hollow canopy roller 213 with which the ends of the strips are pivotably connected at their middle point in the manner of a Venetian blind with vertical lamella—possibly with pivoting limitation. In the closed position shown in FIG. 8 the strips 18 are located in a plane extending through the canopy roller axis. In the position shown in FIG. 9 the strips 18 are turned 90° by the worm gearing 47 relative to the canopy roller 213 so that e.g. wind in the direction parallel to the the plane shown in the drawing can pass through. Finally, FIG. 10 shows how the strips 18, the opposite ends of which are attached to the spanning profile 16, can be rolled up on the canopy roller 213 containing the worm gearing 47. The worm gearing is actuated in a generally known manner.

I claim:

1. In an awning construction which blocks light and wind, while permitting passage therethrough of wind pressure above a predetermined level to prevent damage to said awning;

canopy means having a first end and a second end;

roller means for coiling-up said canopy means; the first end of said canopy means being connected to said roller means;

spanning means connected to said second end of said canopy means and movable relative to said roller means;

said canopy means including a plurality of strip means forming a canopy and extending parallel to each other and substantially retained in a single plane between said roller means and said spanning means; each of said strip means being substantially impervious to air; said strip means each having lateral edges extending in a longitudinal direction of said strip means, said lateral edges of adjacent ones of said strip means being near enough to one another, while substantially not overlapping each other, to form a substantially continuous appearance for said canopy; said strip means having sufficient flexibility, when subjected to said wind pressure, to be deflected by said wind pressure above a predetermined level to individually form an arch to create a space between adjacent said lateral edges to permit the wind to pass through said canopy means; and further comprising releasable fastening means on said lateral edges of said strip means for interconnecting the latter and for being automatically released under a predetermined tension.

2. An awning construction as claimed in claim 1, further comprising connecting means for movably connecting at least one of said strip ends of said plurality of strip means to at least one of said roller means and said spanning means.

3. An awning construction as claimed in claim 2, wherein said connecting means are elastic.

4. An awning construction as claimed in claim 1, wherein said strip means consist of a material exhibiting a low shrinkage tendency longitudinally of said strip means; the longitudinal edges of said strip means being constructed to resist tension.

5. An awning construction as in claim 4 wherein the longitudinal edges of said strip means are subject to tension.

6. An awning construction as in claim 4 wherein the longitudinal edges of said strip means are reinforced while maintaining substantially constant thickness thereof.

7. In an awning construction which blocks light and wind, while permitting passage therethrough of wind pressure above a predetermined level to prevent damage to said awning;

first canopy means having a first end and a second end;

second canopy means having a first end and a second end;

roller means for coiling-up said first and second canopy means in two parallel layers, said first ends of both said canopy means being connected to said roller means;

first spanning means connected to the second end of said first canopy means and movable in a first direction relative to said roller means;

second spanning means connected to the second end of said second canopy means and movable in a second direction relative to said roller means;

first guide means for guiding said first canopy means in said first direction; and second guide means for guiding said second canopy means in said second direction;

each said canopy means including a plurality of strip means forming a canopy and extending parallel to each other and substantially retained in a single plane between said roller means and said spanning means; each of said strip means being substantially impervious to air; said strip means each having lateral edges extending in a longitudinal direction of said strip means, said lateral edges of adjacent ones of said strip means being near enough to one another, while substantially not overlapping each other, to form a substantially continuous appearance for said canopy; said strip means having sufficient flexibility, when subjected to said wind pressure, to be deflected by said wind pressure above a predetermined level to individually form an arch to create a space between adjacent said lateral edges to permit the wind to pass through said canopy means; and further comprising releasable fastening means on said lateral edges of said strip means for interconnecting the latter and for being automatically released under a predetermined tension.

8. An awning construction as claimed in claim 7, wherein said first and second directions extend in the form of a gable roof.

* * * * *